US007621315B2

(12) United States Patent
Han et al.

(10) Patent No.: US 7,621,315 B2
(45) **Date of Patent: *Nov. 24, 2009**

(54) METHOD AND APPARATUS FOR SEMI-SOLID MATERIAL PROCESSING

(75) Inventors: Qingyou Han, Knoxville, TN (US); Xiaogang Jian, Knoxville, TN (US); Hanbing Xu, Knoxville, TN (US); Thomas T. Meek, Knoxville, TN (US)

(73) Assignees: UT-Battelle, LLC, Oak Ridged, TN (US); University of Tennessee Research Foundation, Knoxville, TN (US)

( * ) Notice: Subject to any disclaimer, the term of this patent is extended or adjusted under 35 U.S.C. 154(b) by 0 days.

This patent is subject to a terminal disclaimer.

(21) Appl. No.: 12/357,857

(22) Filed: Jan. 22, 2009

(65) Prior Publication Data

US 2009/0126897 A1 May 21, 2009

Related U.S. Application Data

(63) Continuation of application No. 11/729,614, filed on Mar. 29, 2007, now Pat. No. 7,493,934, which is a continuation of application No. 10/871,180, filed on Jun. 17, 2004, now Pat. No. 7,216,690.

(51) Int. Cl.

| | |
|---|---|
| ***B22D 17/10*** | (2006.01) |
| ***B22D 23/00*** | (2006.01) |
| ***B22D 25/00*** | (2006.01) |
| ***B22D 27/08*** | (2006.01) |

(52) U.S. Cl. ..... 164/113; 164/71.1; 164/312; 164/900

(58) Field of Classification Search ..... 164/71.1, 164/113, 120, 312–320, 900
See application file for complete search history.

(56) References Cited

U.S. PATENT DOCUMENTS

| | | | |
|---|---|---|---|
| 4,373,950 | A | 2/1983 | Shingu et al. |
| 5,994,818 | A | 11/1999 | Abramov et al. |
| 6,402,367 | B1 | 6/2002 | Lu et al. |
| 6,429,575 | B1 | 8/2002 | Abramov et al. |
| 2002/0011321 | A1 | 1/2002 | Aoyama et al. |

(Continued)

FOREIGN PATENT DOCUMENTS

| | | |
|---|---|---|
| JP | 51-92709 | 8/1976 |

OTHER PUBLICATIONS

R. Sebus, et al., "Optimisation of Coil Design for Inductive Heating . . . ," Institute of Electrical Machines, Aachen University of Tech, Germany, pp. 481-487.

(Continued)

*Primary Examiner*—Kuang Lin
(74) *Attorney, Agent, or Firm*—Brinks, Hofer, Gilson & Lione

(57) ABSTRACT

A method of forming a material includes the steps of: vibrating a molten material at an ultrasonic frequency while cooling the material to a semi-solid state to form non-dendritic grains therein; forming the semi-solid material into a desired shape; and cooling the material to a solid state. The method makes semi-solid castings directly from molten materials (usually a metal), produces grain size usually in the range of smaller than 50 μm, and can be easily retrofitted into existing conventional forming machine.

10 Claims, 9 Drawing Sheets

U.S. PATENT DOCUMENTS

| | | | |
|---|---|---|---|
| 2003/0062144 | A1 | 4/2003 | Aoyama et al. |
| 2003/0173053 | A1 | 9/2003 | Boehnke |
| 2004/0055726 | A1 | 3/2004 | Hong et al. |

OTHER PUBLICATIONS

M. C. Flemings et al., "Rheocasting," Materials Science and Engineering, 1976, pp. 103-117, vol. 25.

Merton C. Flemings, "Behavior of Metal Alloys in the Semisolid State," The 1990 Edward Campbell Memorial Lecture, May 1991, pp. 957-981, vol. 22A.

D. H. Kirkwood, "Semisolid Metal Processing," International Materials Reviews, 1994, pp. 173-189, vol. 39, No. 5.

Q. Han, et al., "Particle Pushing: The Concentration of Particles Near a Solid Interface . . . ," The Journal of Crystal Growth, 1994, pp. 398-405, vol. 140.

Q. Han, et al., "Redistribution of Particles During Solidification," ISIJ International, 1995, pp. 693-699, vol. 35, No. 6.

D. B. Spencer, et al., "Rheological Behavior of Sn-15 Pct Pb in the Crystallization Range," Metallurgical Transactions, 1972, pp. 1925-1932, vol. 3.

M. Garat, et al., "Aluminium Semi-Solid Processing: From the Billet to the Finished Part," pp. xvii-xxxi.

Oleg V. Abramov, "High-Intensity Ultrasonics," Kumakov Instute of General and Inorganic Chemistry, pp. 370-371, Overseas Publishers Assoc., 1998.

G. I. Eskin, "Ultrasonic Treatment of Light Alloy Melts," All-Russia Institute of Light Alloys, pp. 166-185, Overseas Publishers Assoc., 1998.

"Advanced Casting Research Center (ACRC) Consortium Meeting," Report 01-#1, Metal Processing Institute, May 2001, www.wpi.edu/+mpi.

John L. Jorstad, "SLC, A Novel New & Economical Approach to Semi Solid Metal (SSM) Casting," pp. 1-21 (Powerpoint Presentation).

METHOD AND APPARATUS FOR SEMI-SOLID MATERIAL PROCESSING

CROSS-REFERENCE TO RELATED APPLICATIONS

The present patent document is a continuation of U.S. patent application Ser. No. 11/729,614, which was filed on Mar. 29, 2007, and is a continuation of U.S. patent application Ser. No. 10/871,180, which was filed on Jun. 17, 2004 and is now U.S. Pat. No. 7,216,690. The entire contents of the aforementioned patent documents are hereby incorporated by reference.

FEDERALLY SPONSORED RESEARCH OR DEVELOPMENT

The United States Government has rights in this invention pursuant to contract no. DE-AC05-00OR22725 between the United States Department of Energy and UT-Battelle, LLC.

FIELD OF THE INVENTION

The present invention relates to semi-solid processing of materials, and more particularly to semi-solid processing of materials using ultrasonic vibration to form non-dendritic grains therein.

BACKGROUND OF THE INVENTION

Thixocasting and rheocasting are widely used industrial processes for high volume production of SSM components. Problems associated with such processing include: costly and complex feed (process) material preparation (thixocasting); material loss (thixocasting), agglomeration, and grain coarsening during process material preparation (rheocasting), causing large grain size in the product; costly equipment to hold semi-solid slurry process material at constant temperatures (rheocasting); low solid fractions of process materials (rheocasting); and oxidation of process material during processing.

OBJECTS OF THE INVENTION

Accordingly, objects of the present invention include: methods of forming a semi-solid structure directly from molten metal prior to metal forming (e.g., casting, forging) with desired fraction solid, producing grain size much smaller than thixocasting and rheocasting, reducing or eliminating process run-around, and reusing process run-around if there is any. Further and other objects of the present invention will become apparent from the description contained herein.

SUMMARY OF THE INVENTION

In accordance with one aspect of the present invention, the foregoing and other objects are achieved by a method of forming a material that includes the steps of: vibrating a molten material at an ultrasonic frequency while cooling the material to a semi-solid state to form non-dendritic grains therein; forming the semi-solid material into a desired shape; and cooling the material to a solid state.

In accordance with another aspect of the present invention, a machine for forming a material includes means for vibrating a molten material at an ultrasonic frequency while cooling the material to a semi-solid state to form non-dendritic grains therein.

In accordance with another aspect of the present invention, an article includes a semi-solid-processed body characterized by globular, non-dendritic grains having an average diameter of no more than 1000 μm.

BRIEF DESCRIPTION OF THE DRAWINGS

Equivalent components are assigned the same reference numerals throughout the drawings.

For a better understanding of the present invention, together with other and further objects, advantages and capabilities thereof, reference is made to the following disclosure and appended claims in connection with the above-described drawings.

DETAILED DESCRIPTION OF THE INVENTION

The present invention is carried out by "ultrasonic processing," which comprises vibrating molten process material (usually a metal) at an ultrasonic frequency as it cools to a semi-solid state in order to form non-dendritic, (i.e., globular-shaped, rounded), ideally spherical) grains having an average diameter of no more than 1000 μm, preferably no more than 100 μm, more preferably no more than 50 μm, most preferably no more than 1 μm. Such grain structure is most beneficial for semi-solid forming processes. Ultrasonic processing in accordance with the present invention generally avoids formation of large and/or dendritic grains in the process material.

In accordance with the present invention, vibration at an ultrasonic frequency is operably applied at a frequency in the range of 1 kHz to $10^6$ kHz, preferably in the range of 15 kHz to 25 kHz, and at a power intensity in the range of 1 W to $10^6$ W, preferably in the range of 500 to 1000 W. The duration of ultrasonic processing is in the range of 1 millisecond to one hour depending on the type and volume of metal being processed. Once the beneficial results of ultrasonic processing are achieved, continued subjection of the process material is not deleterious; therefore duration is not considered to be a critical parameter.

Figure 1:
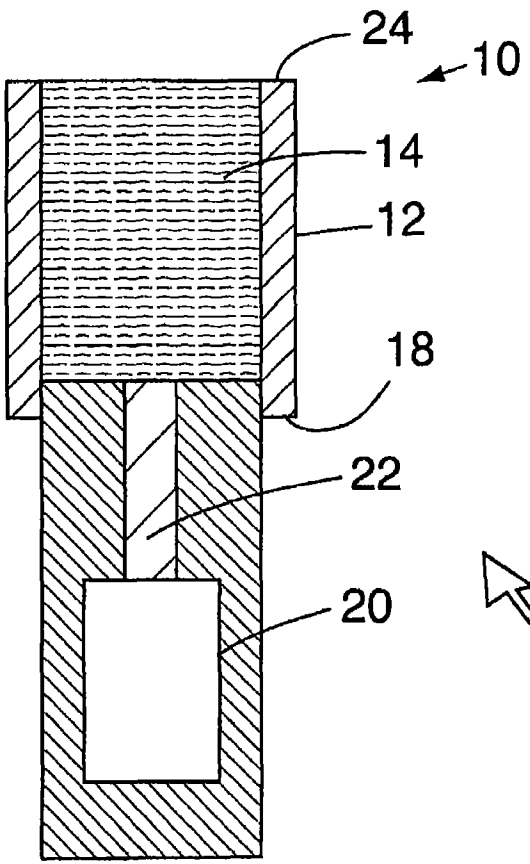
FIG. 1 is a schematic cutaway side view of an ultrasonic processor in accordance with the present invention.

Referring to FIG. 1, an example of a basic apparatus for carrying out the present invention comprises an ultrasonic processor 10. A cylindrical sleeve 12 contains molten and/or semi-solid process material 14. A ram (piston) 16 is inserted into the lower end 18 of the sleeve 12. An ultrasonic transducer 20 produces ultrasonic vibration that is transmitted to the process material 14 via an ultrasonic radiator (horn) 22. Process material 14 is transferred into and out of the sleeve 12 through the upper end 24 thereof.

In operation, molten process material 14 is transferred into the ultrasonic processor 10 at a temperature of at least above the solidus temperature of the process material 14. The ultrasonic transducer 20 produces ultrasonic vibration that is transmitted to the process material 14 via an ultrasonic radiator (horn) 22. The process material 14 cools to the semi-solid state while being exposed to ultrasonic vibration. The ultrasonic vibration promotes nucleation and the formation of predominantly non-dendritic, generally globular grains. The ram 16 then pushes the semi-solid process material 14 as a slug (billet) out of the sleeve 12 through the upper end 24 thereof to transfer the semi-solid process material 14 to a forming machine. The non-dendritic, generally spherical grains persist throughout the forming process.

Some embodiments of the present invention include a conveyer interposed in the process between a heater that melts the process material and a forming machine that forms the process material. Any conveyer that can support at least one ultrasonic processor 10 is contemplated to be suitable for application to the present invention. It is preferred that a conveyer support a plurality of ultrasonic processors 10. Examples of conveyers are set forth below to show the general principle of the present invention.

Figure 2:
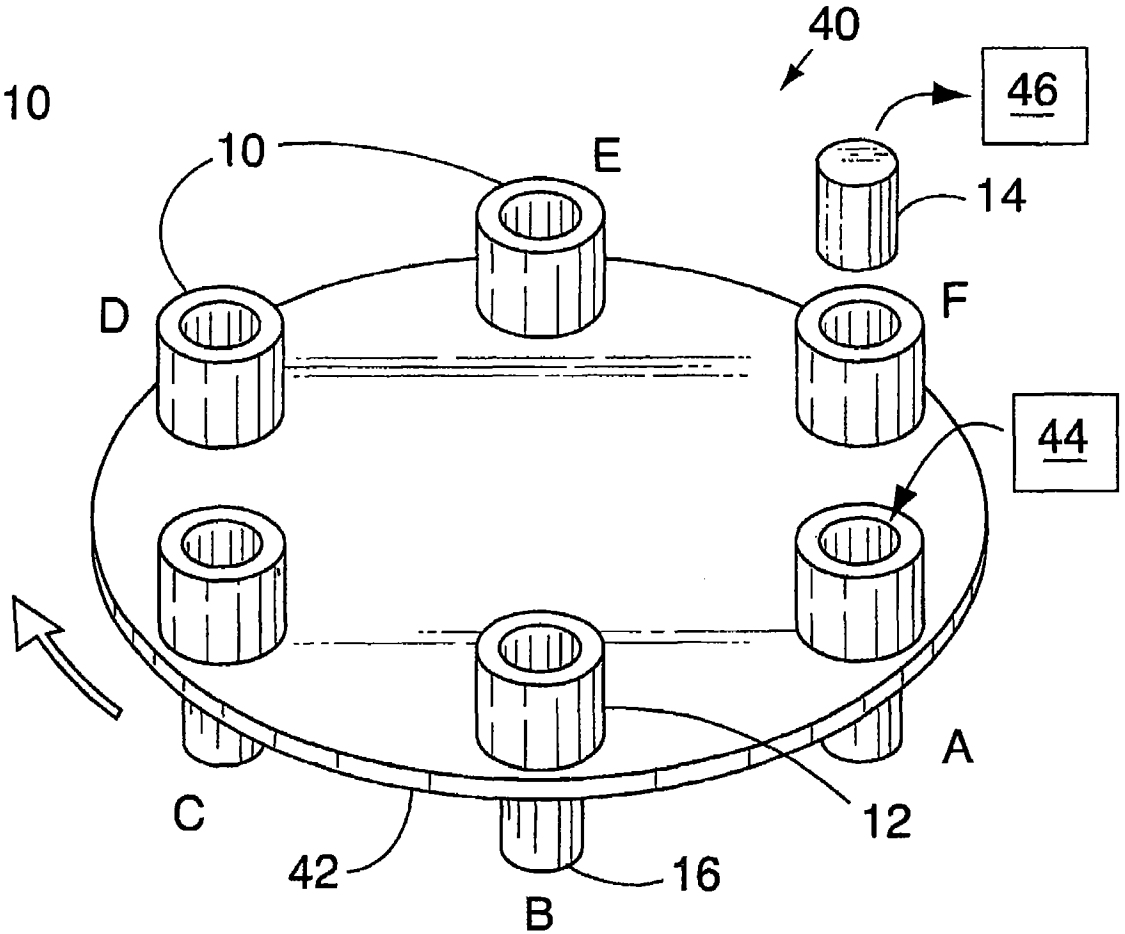
FIG. 2 illustrates an embodiment of the present invention using a turntable conveyer.

Referring to FIG. 2, a conveyer 40 comprises a turntable 42 that supports a plurality of ultrasonic processors 10. The turntable 42 having six positions A-F is indexed so that an ultrasonic processor 10 is aligned with the furnace 44 in position A and another ultrasonic processor 10 is aligned with the forming machine 46 in position F. As the turntable 42 rotates clockwise (in the direction of the arrow), molten process material 14 is transferred from the furnace 44 to the ultrasonic processors 10 while semi-solid slugs of process material 14 are transferred to the forming machine 46. As the ultrasonic processors 10 rotate through positions B, C, D, and E, the process material 14 is cooled to a semi-solid state while undergoing exposure to ultrasonic vibration, causing the formation of predominantly non-dendritic, generally spherical grains in the process material 14, which persist through the forming process.

Figure 3:
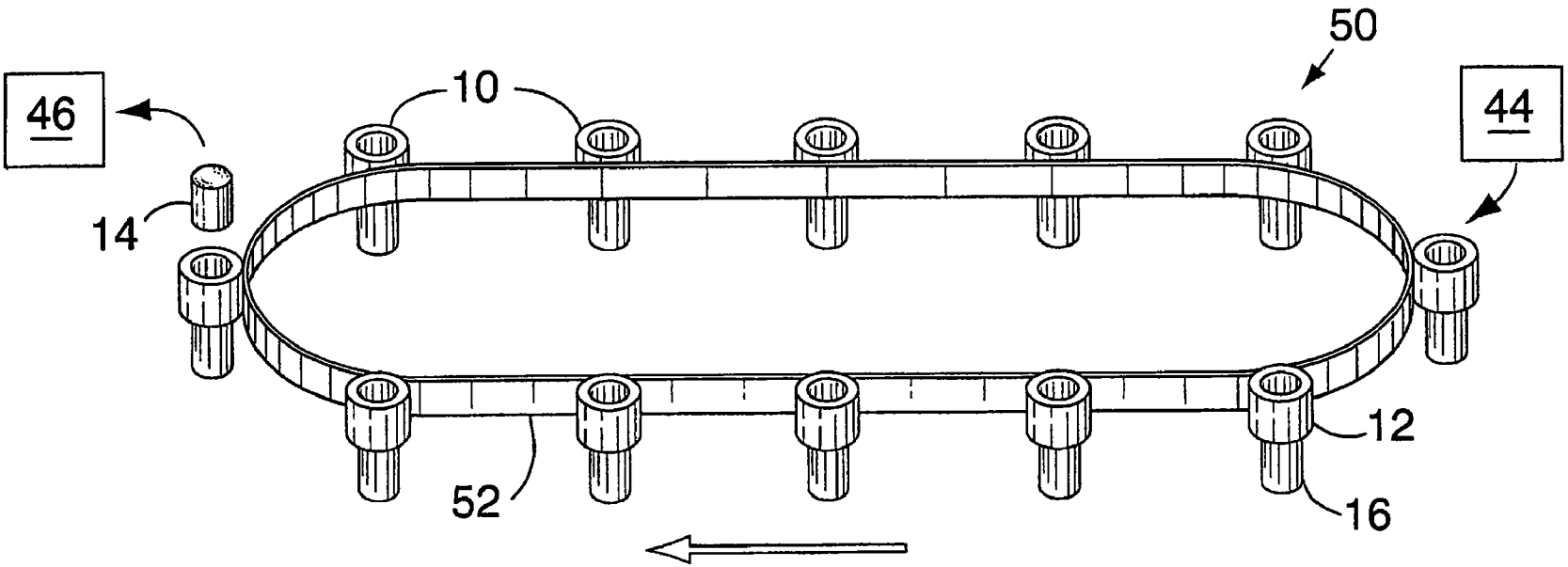
FIG. 3 illustrates an embodiment of the present invention using a chain-type conveyer.
Figure 4A:
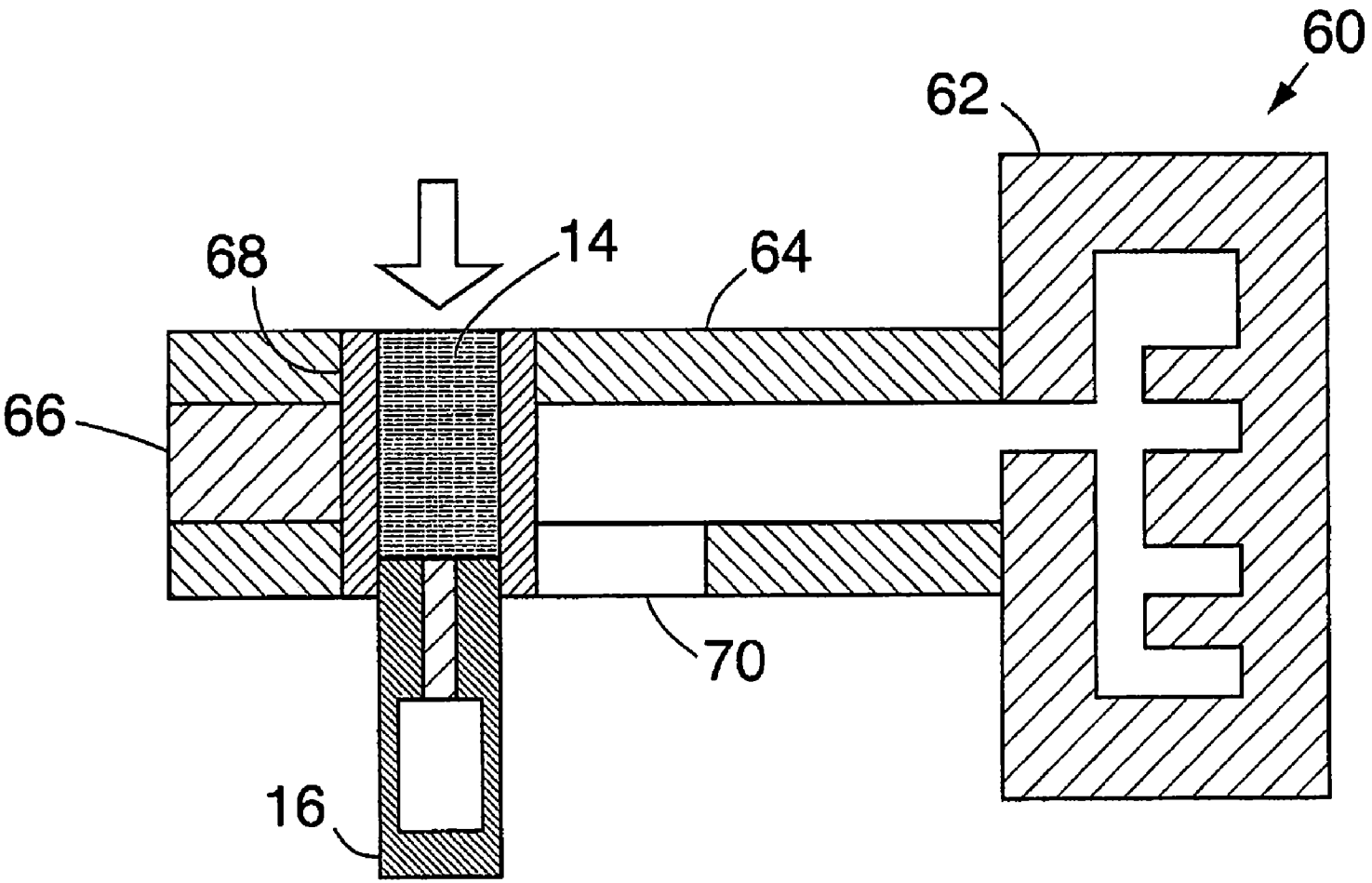
FIGS. 4(*a*)-4(*e*) illustrate an embodiment of the present invention wherein a forming machine (die caster) is modified to incorporate an ultrasonic processor directly into its mechanism.
Figure 4B:
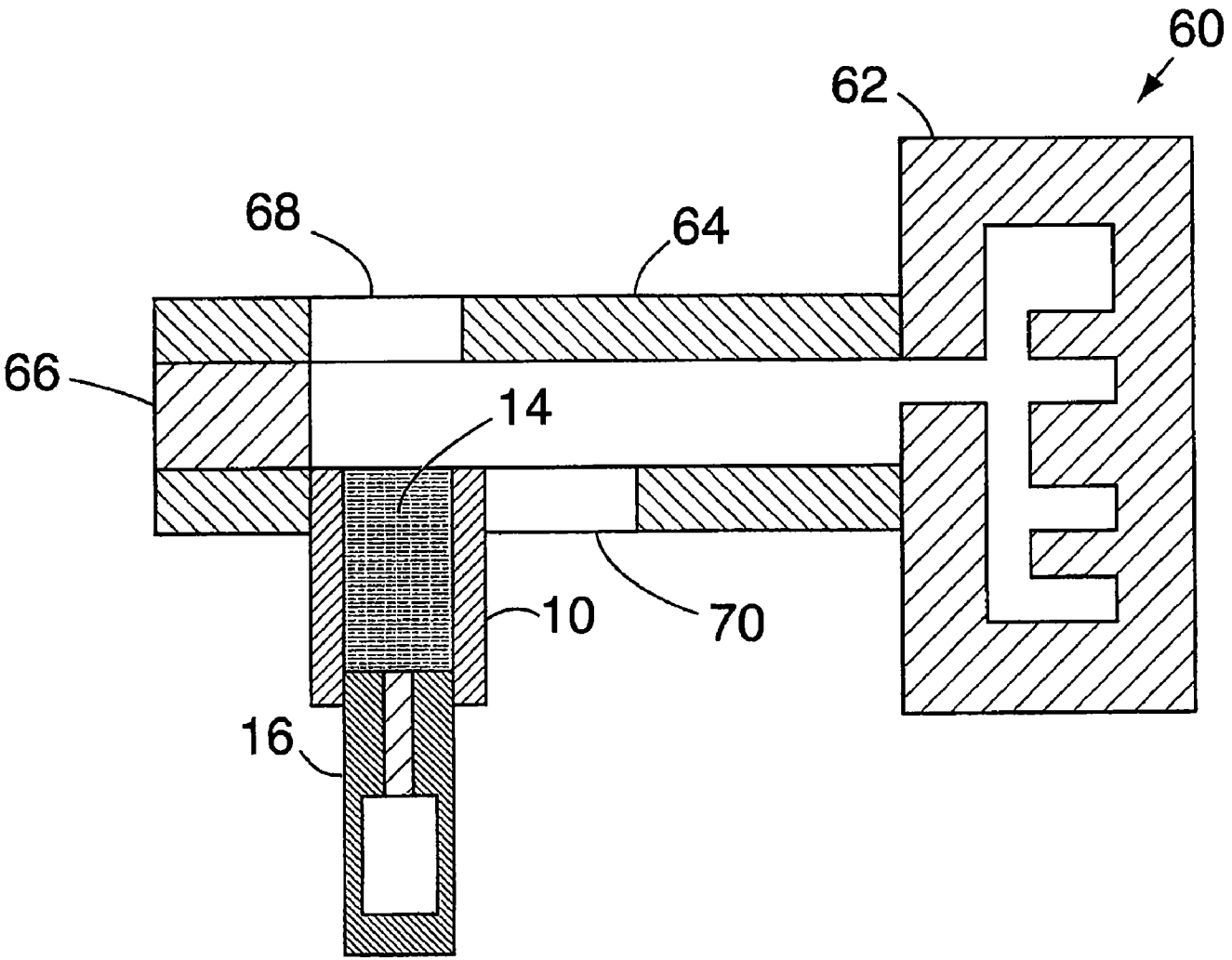
Figure 4C:
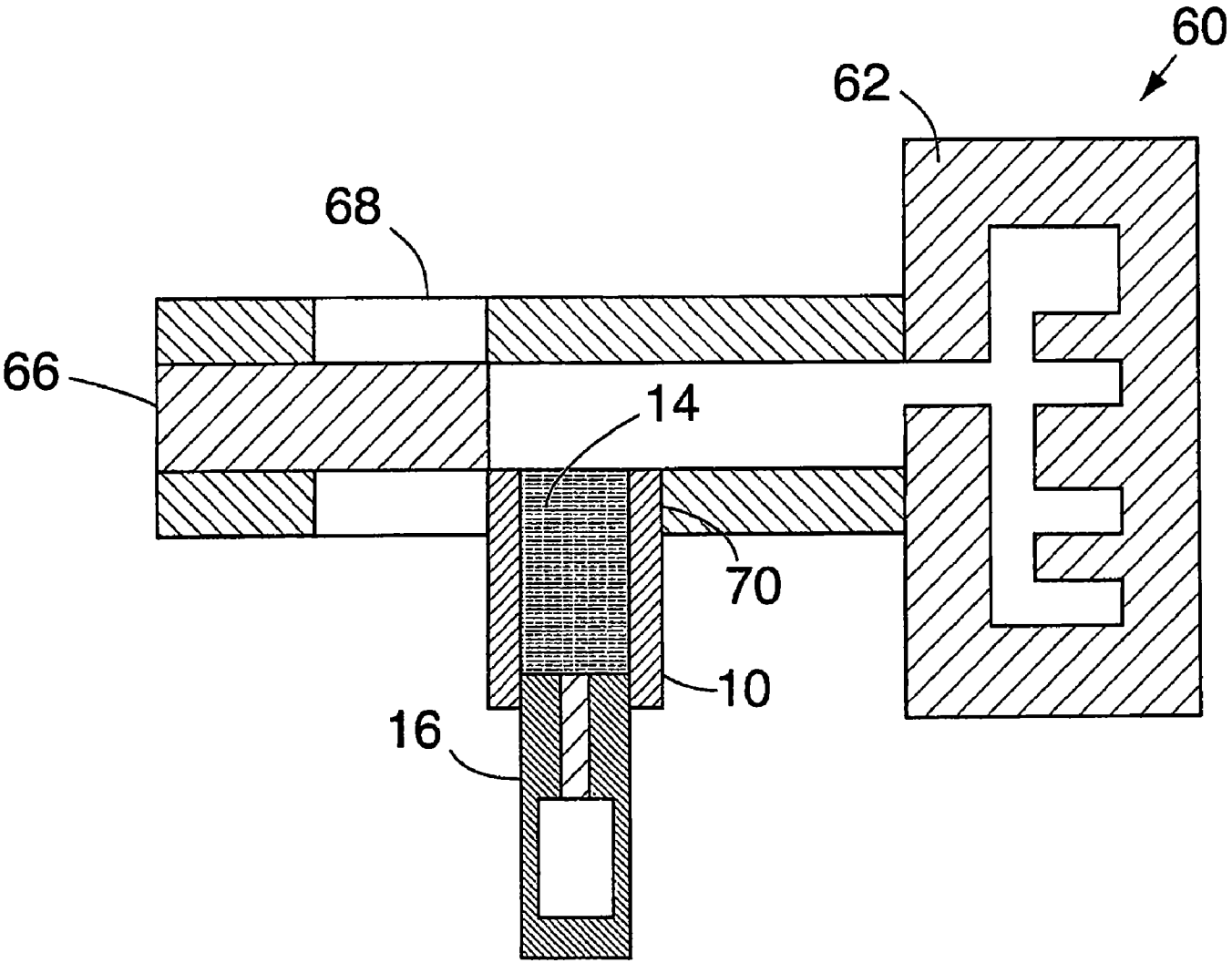
Figure 4D:
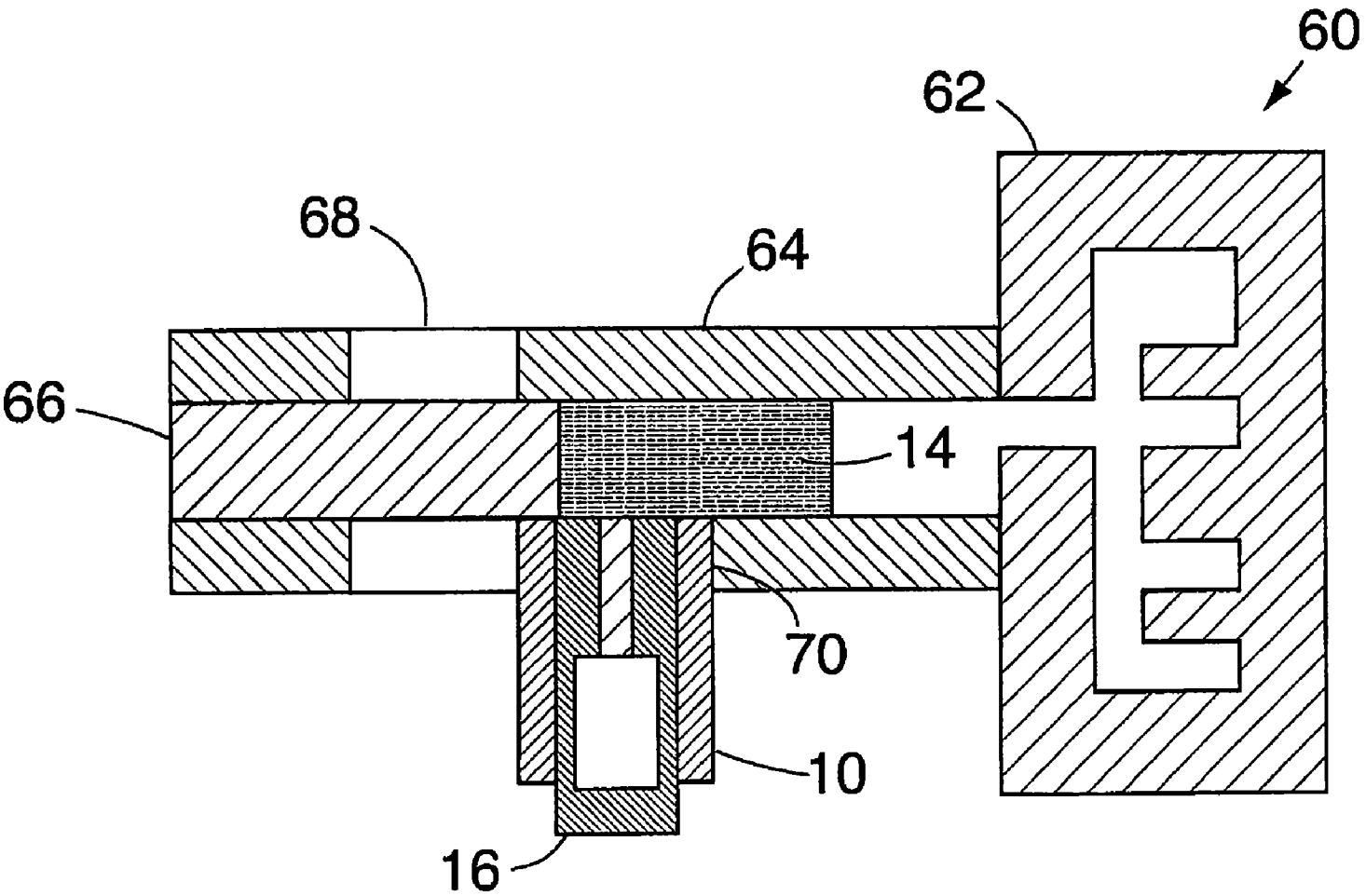
Figure 4E:
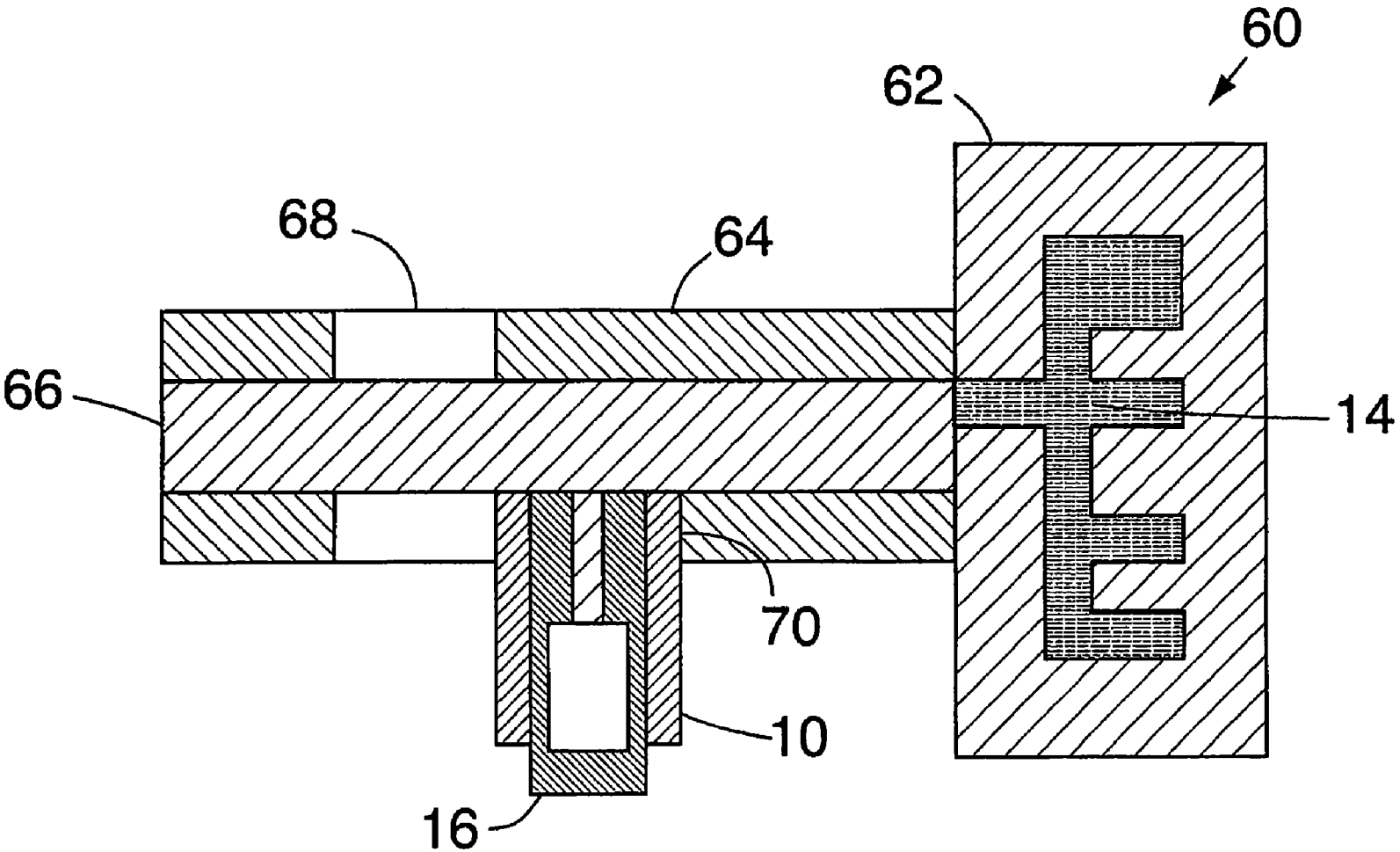

FIG. 3 illustrates an embodiment wherein a conveyer 50 comprises a belt or chain 52 with ultrasonic processors 10. The furnace 44 and forming machine 46 can be at any desired location, and the belt or chain 52 can be in any desired configuration.

In other embodiments of the present invention, the forming machine is modified to incorporate an ultrasonic processor directly into its mechanism. Molten process material is transferred directly to the forming machine and the ultrasonic processing takes place therein.

FIGS. 4(*a*)-4(*e*) illustrate an embodiment of the present invention wherein a die-casting machine 60 is modified to incorporate an ultrasonic processor 10 directly into its shot-sleeve 64.

In FIG. 4(*a*) an ultrasonic processor 10 is inserted into an opening 68 in the shot-sleeve 64 just ahead of the injection ram 66. Molten process material 14 is transferred into the ultrasonic processor 10 where it is processed in accordance with the present invention.

In FIG. 4(*b*) the ultrasonic processor 10 retracts downwardly sufficiently to allow the injection ram 66 to pass thereover. In FIG. 4(*c*) the ultrasonic processor 10 and the injection ram 66 advance toward the casting die 62 sufficiently to close the opening 68, which has an extension 70 therein to accommodate advance of the ultrasonic processor 10.

In FIG. 4(*d*), ultrasonic processing having been completed, the ram 16 of the ultrasonic processor 10 advances and forces the process material 14 into the shot-sleeve 64. In FIG. 4(*e*) the injection ram 66 advances and forces the process material 14 into the die 62.

Within the scope of the present invention, an ultrasonic processor can be brought into operable communication with process material in any configuration. For example, an ultrasonic processor can be attached to a vessel wall, or can be inserted directly into the process material.

EXAMPLE I

Figure 5:
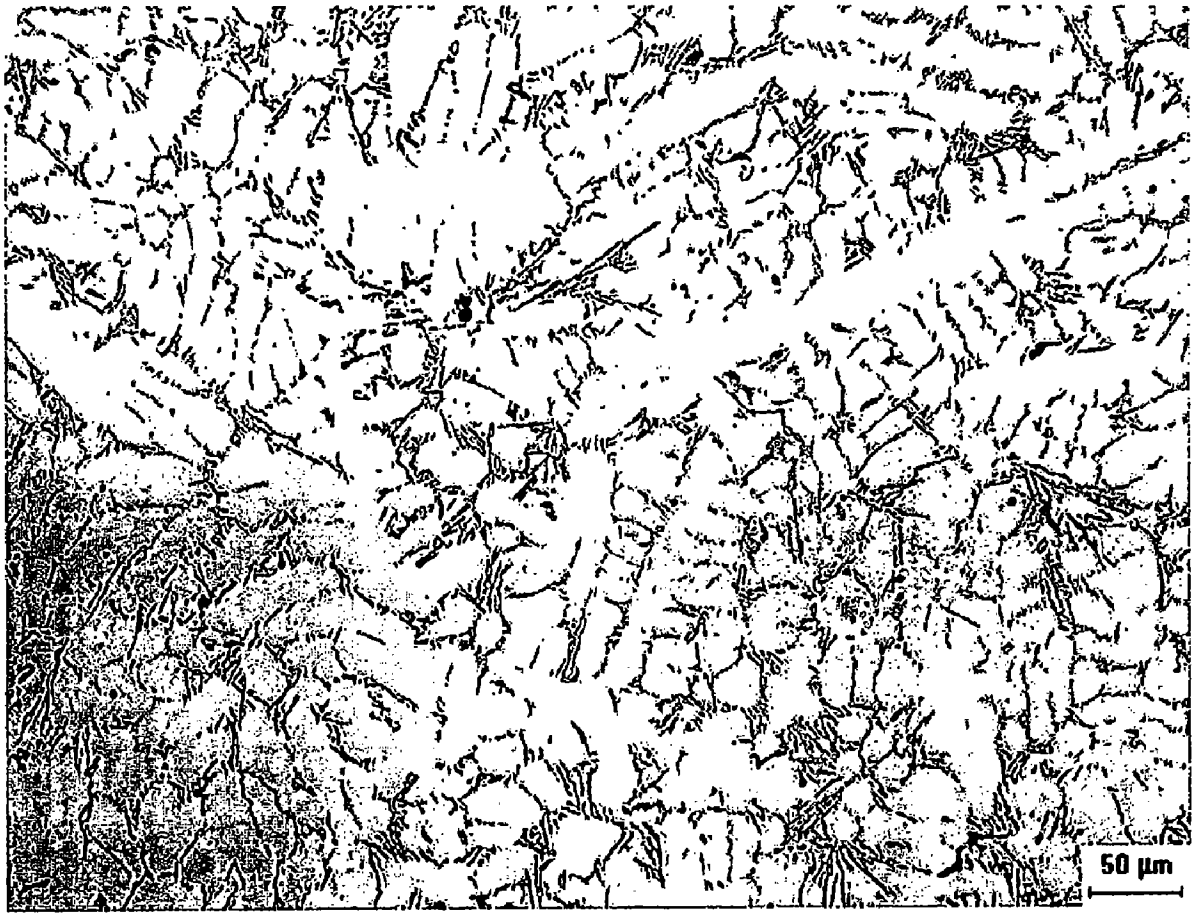
FIG. 5 is a photomicrograph of aluminum A356 alloy cooled in a copper mold with no ultrasonic vibration.

An acoustic radiator was attached to the bottom of a copper mold. Aluminum alloy A356 was melted and poured into the mold and allowed to cool to a solid state with no ultrasonic vibration. The microstructure of the resultant solid alloy is shown in FIG. 5. The grains are observed to be large (1-10 mm) and dendritic. The microstructure is deleterious to semi-solid processing, especially forming.

EXAMPLE II

Figure 6:
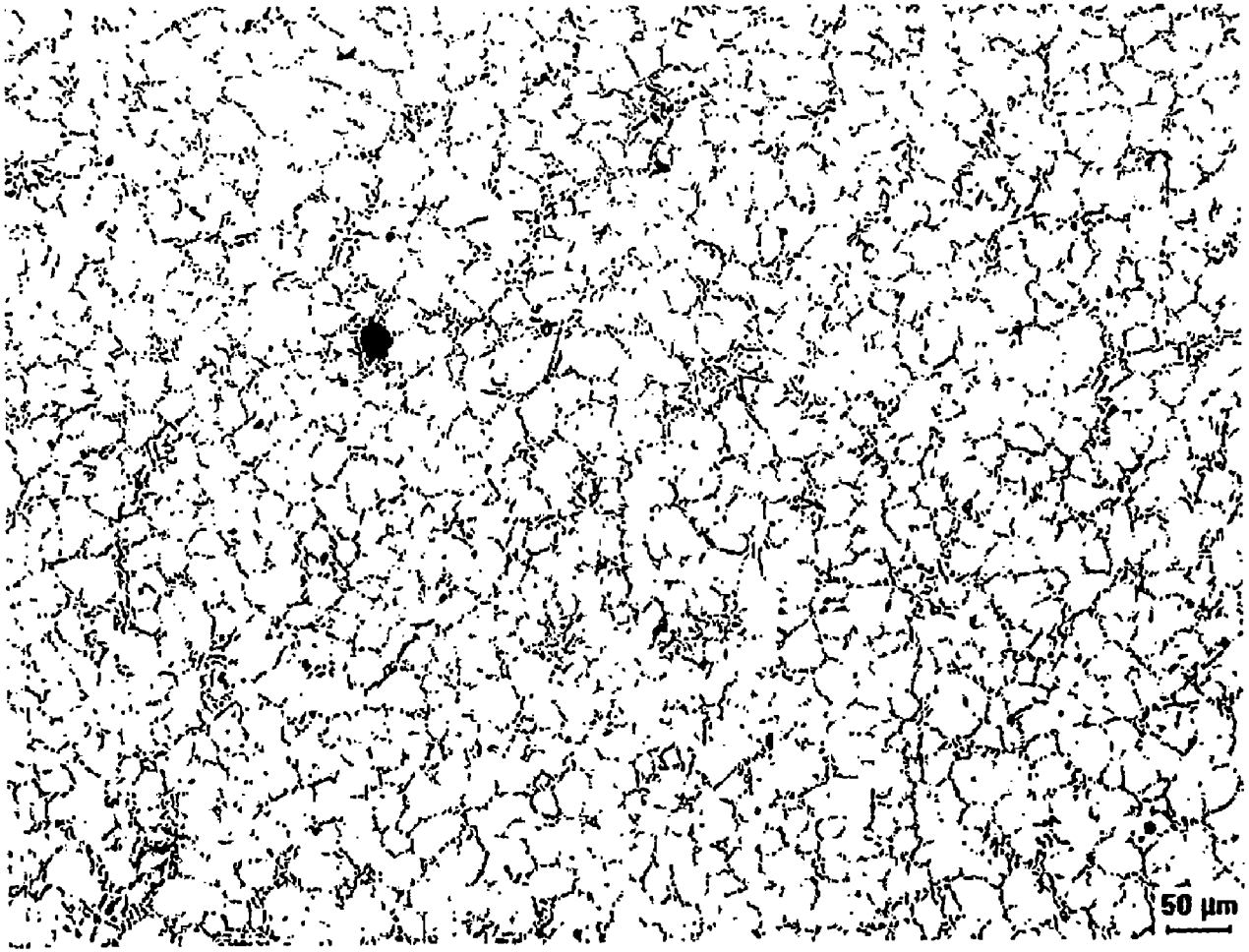
FIG. 6 is a photomicrograph of aluminum A356 alloy cooled in a copper mold with ultrasonic vibration in accordance with the present invention.

An acoustic radiator was attached to the bottom of a copper mold. Aluminum alloy A356 was melted and poured into the mold and allowed to cool to a solid state while being exposed to ultrasonic vibration in accordance with the present invention. The microstructure of the resultant solid alloy is shown in FIG. 6. The grains are observed to be smaller than 50 μm in diameter and globular—ideal for semi-solid processing.

Utilization of the present invention provides the advantage of resource savings because less capital investment (equipment, etc.) and energy are required to carry out the present invention than that required by conventional technology. Moreover, the present invention allows for the reuse of the process run-around (5% of the feedstock metals). Moreover, less oxide waste is produced because there is less exposure of process material to air.

Moreover, the present invention enables a large process window for semi-solid processing because the metal is held in containers throughout the processing shown in FIG. 4. The process material can be injected into a forming machine at any desired solid fraction.

Although the present invention is generally used to process metallic materials, other materials can be processed in accordance with the present invention, for example, polymers, ceramics, and composite materials.

While there has been shown and described what are at present considered the preferred embodiments of the present invention, it will be obvious to those skilled in the art that various changes and modifications can be prepared therein without departing from the scope of the inventions defined by the appended claims.

What is claimed is:

1. A method of forming a material, the method comprising:

transferring molten or semi-solid process material directly to a die-casting machine including a shot-sleeve; and ultrasonic processing the process material in the shot-sleeve, wherein transferring includes inserting an ultrasonic processor into a transverse opening in the shot-sleeve just ahead of an injection ram, the ultrasonic processor comprising a second sleeve for containing the process material and a transducer positioned to transmit ultrasonic vibrations to the process material.

2. The method of claim 1, wherein the ultrasonic processing of the process material in the shot-sleeve occurs at a frequency in the range of from 15 kHz to 25 kHz and at a power intensity in the range of from 500 to 1000 W.

3. The method of claim 1, wherein transferring includes retracting the ultrasonic processor within the transverse opening in the shot-sleeve just ahead of the injection ram.

4. The method of claim 3, wherein transferring includes advancing the ultrasonic processor and the injection ram toward a casting die sufficiently to close the transverse opening, the transverse opening having an extension therein to accommodate advance of the ultrasonic processor.

5. The method of claim 4, further comprising advancing a ram of the ultrasonic processor to force the process material into the shot-sleeve after the ultrasonic processing.

6. The method of claim 4, further comprising advancing the injection ram to force the process material into the casting die.

7. A machine for forming a material, the machine comprising:

a die-casting machine including a shot-sleeve and a casting die, wherein an ultrasonic processor is incorporated directly into the shot-sleeve, the ultrasonic processor including a second sleeve for containing molten or semi-solid process material and being advanceable in the shot sleeve and a transducer positioned to transmit ultrasonic vibrations to the process material, and wherein the shot-sleeve includes a transverse opening sized to receive the ultrasonic processor, the opening just ahead of an injection ram when the injection ram is retracted.

8. The machine of claim 7, wherein the ultrasonic processor and the injection ram are advanceable toward the casting die sufficiently to close the transverse opening, the transverse opening having an extension therein to accommodate advance of the ultrasonic processor.

9. The machine of claim 7, wherein the ultrasonic processor operates at a frequency in the range of from 15 kHz to 25 kHz and at a power intensity in the range of from 500 to 1000 W.

10. The machine of claim 7, further comprising a piston at the end of the second sleeve for forcing the process material into the shot-sleeve.

* * * * *